United States Patent [19]

Kumamoto et al.

[11] Patent Number: 4,728,209

[45] Date of Patent: Mar. 1, 1988

[54] PRINTING APPARATUS HAVING A MEMORY FOR STORING COMPOSITE AND PRINTED CHARACTER INFORMATION FOR SUBSEQUENT ERASURE

[75] Inventors: Michihisa Kumamoto, Tokyo; Hiroyuki Ueda, Kawasaki, both of Japan

[73] Assignee: Canon Kabushiki Kaisha, Tokyo, Japan

[21] Appl. No.: 29,387

[22] Filed: Mar. 23, 1987

Related U.S. Application Data

[63] Continuation of Ser. No. 904,814, Sep. 8, 1986, abandoned, which is a continuation of Ser. No. 685,977, Dec. 28, 1984, abandoned, which is a continuation of Ser. No. 414,890, Sep. 3, 1982, abandoned.

[30] Foreign Application Priority Data

Sep. 24, 1981 [JP] Japan ..... 56-149381
Sep. 24, 1981 [JP] Japan ..... 56-149382
Sep. 25, 1981 [JP] Japan ..... 56-150680

[51] Int. Cl.[4] ..... B41J 29/16

[52] U.S. Cl. ..... 400/697.1; 400/63; 400/611; 400/904

[58] Field of Search ..... 400/16, 17, 22, 63, 400/109, 111, 171, 307.2, 611, 696, 697, 697.1, 904

[56] References Cited

U.S. PATENT DOCUMENTS 3,380,568 4/1968 Adams et al. ..... 400/63
3,630,336 12/1971 Johnson et al. ..... 400/17
3,780,846 12/1973 Kolpek et al. ..... 400/697.1 X
3,888,340 6/1975 Hoffman ..... 400/611
3,976,990 8/1976 Haak ..... 400/904 X
4,037,705 7/1977 Martin et al. ..... 400/904 X
4,244,657 1/1981 Wasylyk ..... 400/109
4,270,865 6/1981 Konishi ..... 400/697 X
4,285,605 8/1981 Lloyd et al. ..... 400/307.2 X
4,286,889 9/1981 Ebert et al. ..... 400/697.1
4,392,758 7/1983 Bowles et al. ..... 400/697.1

FOREIGN PATENT DOCUMENTS 0044862 3/1980 Japan ..... 400/171
1282558 7/1972 United Kingdom ..... 400/904

OTHER PUBLICATIONS

IBM Technical Disclosure Bulletin, "Type Font Tray", Harris et al., vol. 17, No. 5, Oct. 1974, p. 1266.

IBM Technical Disclosure Bulletin, "Multiple Character Erase", Hanft et al., vol. 23, No. 3, Aug. 1980, pp. 1107–1108.

IBM Technical Disclosure Bulletin, "Underscoring Half-Indexed Characters", Hana et al., vol. 23, No. 9, Feb. 1981, pp. 4030–4031.

*Primary Examiner*—Ernest T. Wright, Jr.
*Attorney, Agent, or Firm*—Fitzpatrick, Cella, Harper & Scinto

[57] ABSTRACT

A printer has a memory for storing character information on printed characters; character information on a composite character consisting of at least two characters is stored in the memory to simplify the correction operation. Print form/print pitch information which is common to a plurality of characters is stored in a common area of the memory to improve the efficiency of usage of the memory.

13 Claims, 20 Drawing Figures

PRINTING APPARATUS HAVING A MEMORY FOR STORING COMPOSITE AND PRINTED CHARACTER INFORMATION FOR SUBSEQUENT ERASURE

This application is a continuation of application Ser. No. 904,814 filed Sept. 8, 1986, now abandoned, which is a continuation of Ser. No. 685,977, filed Dec. 28, 1984, now abandoned, which is a continuation of Ser. No. 414,890, filed Sept. 3, 1982, now abandoned.

BACKGROUND OF THE INVENTION

1. Field of the Invention

The present invention relates to a printing apparatus, and more particularly to a printer suitable for use in an electronic typewriter having an automatic correction function.

2. Description of the Prior Art

Many types of electronic typewriters have an automatic correction function for automatically correcting a printed character. For example, such a typewriter is shown in U.S. Pat. No. 3,780,846. In such a typewriter, character information is stored in a line buffer memory (such as memory 40 shown in FIG. 1 of U.S. Pat. No. 3,780,846) for the automatic correction function, and the content of the memory is retrieved as required to effect the correction. No character key need be depressed since a correction key need only be depressed to correct the printed character. This system is very convenient to an operator but has the following problem.

For example, assuming that a fraction "½" is to be printed. After "1" has been printed in superscript, a dash "—" is printed. In this case, information on the printed "1" stored in the line buffer memory LB (such as memory 40 shown in U.S. Pat. No. 3,780,846) is deleted from the line buffer LB and information on the dash "—" is substituted therefor as shown in FIGS. 1(A) and 1(B). Accordingly, when the characters representing the printed fraction are to be erased, all of the characters of the fraction cannot be erased by one correction key depression but rather must be erased one character at a time by manual operation or other means. This erasing operation is very troublesome and time-consuming.

When a composite character such as "¥" is to be printed, "Y" is printed and then "=" is overprinted. In this case, character information on the printed "Y" stored in the line buffer LB is deleted when "=" is printed and character information on "=" is substituted therefor. As a result, it is not possible to simultaneously erase the characters "Y" and "=" of the composite character "¥" by depression of the correction key, and the non-erased character must be erased by other means. Again, this erasing operation is trouble-some and time-consuming.

SUMMARY OF THE INVENTION

It is a first object of the present invention to provide a printing apparatus capable of erasing a composite character by one correction key depression.

When character information is stored in the line buffer memory, print information on a print pitch of a string of characters already printed and a character form (e.g. character with underline or Gothic character, etc.) are necessary to represent each character printed. In the character information and the print information (pitch and form) are paired and stored in the line buffer memory as fixed length information, it may be acceptable when the print information frequently varies. Normally, however, the print information does not vary frequently and only the character information varies. Accordingly, it is desirable that a printer store the print information in the line buffer memory as variable length information so that the required capacity of the line buffer memory, that is the amount of line buffer storage needed, is reduced and the line buffer memory is effectively utilized.

It is, therefore, a second object of the present invention to provide a printer which utilizes a limited capacity line buffer memory in a very effective manner.

DETAILED DESCRIPTION OF THE PREFERRED EMBODIMENTS

Figure 1:
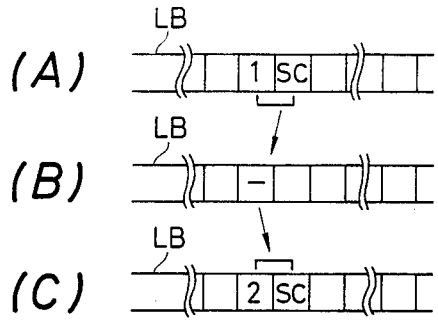
FIG. 1 PRIOR ART
FIG. 1 illustrates in steps A through C the processing of character information in a line buffer memory of a prior art printer.
Figure 2:
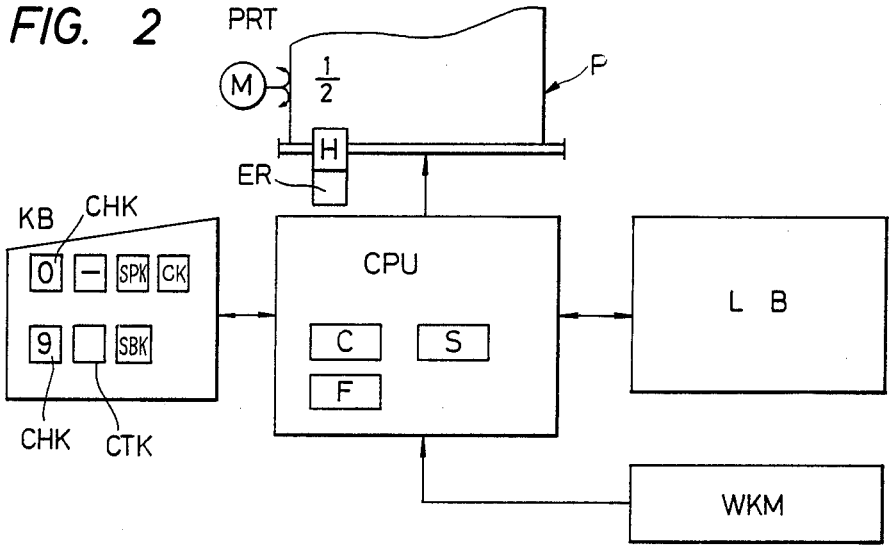
FIG. 2 shows a control block diagram of a first embodiment of the present invention.

FIG. 2 shows a block circuit diagram of a first embodiment of the present invention. KB denotes a keyboard which has numeric keys "0"-"9", a dash key "—", a superscript key SPK, a subscript key SBK, a correction key CK and other character keys CHK and control keys CTK.

CPU denotes a central processing unit and PRT denotes a printer having a print head H having an erasing mechanism ER and a motor M for feeding a print paper P vertically. The print head H is moved from left to right to print characters. The CPU has a register S for storing a distance of vertical movement of the print paper P, a flag F for identifying printing or erasing, and a register C for storing the character information. LB denotes a line buffer memory such as the memory 40 shown in U.S. Pat. No. 3,780,846, which stores information on the printed character, and WKM denotes a working memory for substituting the character information in the line buffer memory LB.

Figure 8:
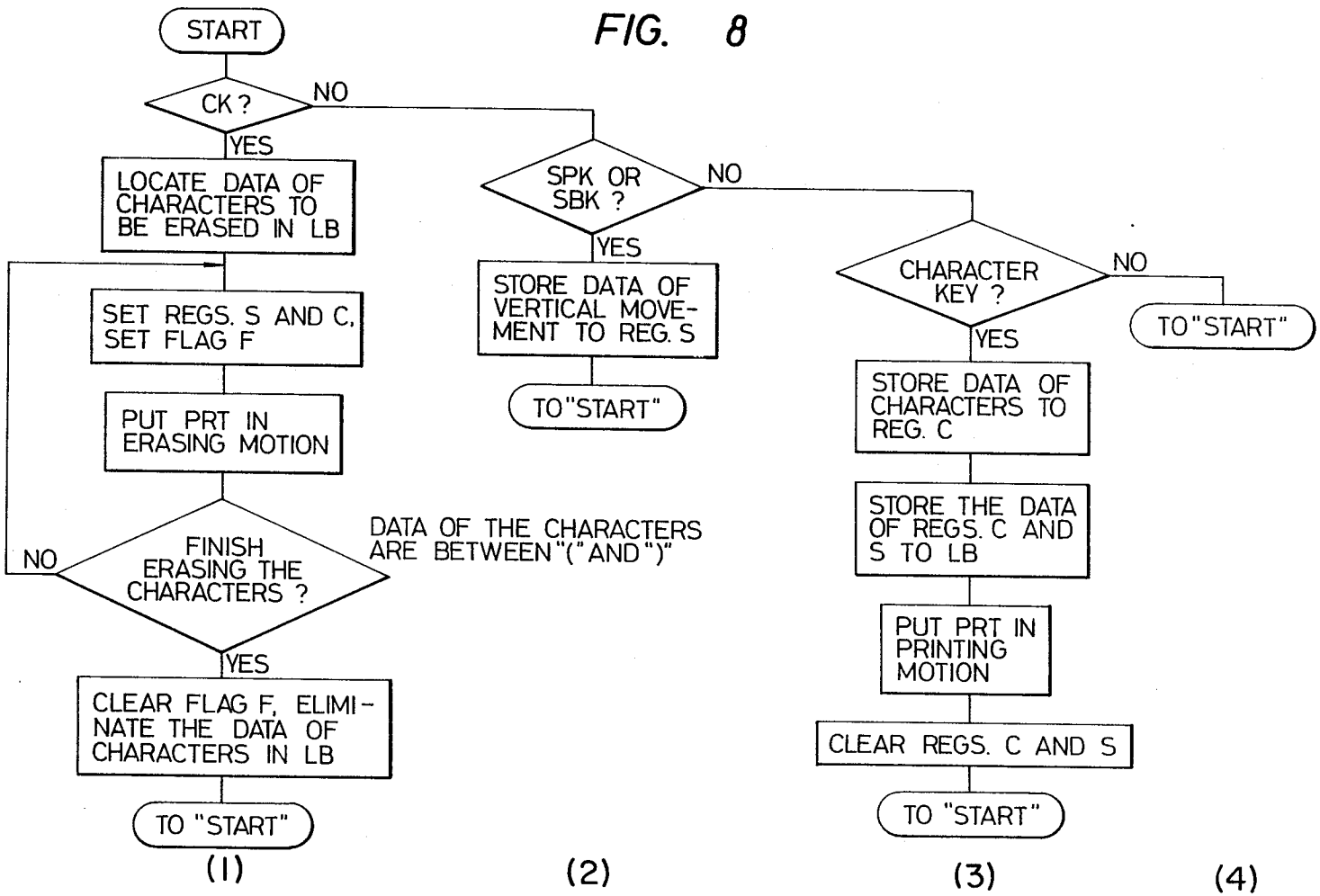
FIGS. 8, 9 and 10A and 10B show flow charts for the operations of the first, second and third embodiments, respectively.

The operation of the present embodiment to print "½" will now be described. FIG. 8 shows a flow chart of this operation.

Figure 3:
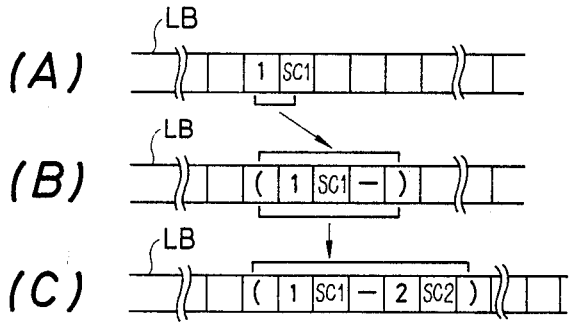
FIG. 3 illustrates in steps A through C the processing of character information in a line buffer memory utilized in the present invention.

When the correction key CK has not been depressed and when the superscript key SPK is depressed, the motor M is rotated to move the print paper P downward by a distance corresponding to one half of a line and the CPU stores the distance of movement SC1 into the register S as shown in the branch 2 of FIG. 8. When the character key "1" is next depressed, the CPU stores the character information 1 into the register C and writes the contents of the registers C and S into the line buffer memory LB as shown in FIG. 3(A) and in branch 3 of FIG. 8. The printer PRT prints "1" and immediately thereafter the motor M moves the print paper P upward by one half of line pitch to restore it to the original position. The print head H is moved to the next print position and the registers C and S are cleared again as shown in branch 3 of FIG. 8. Then, the print head H is returned to the print position of "1" and the key representing the dash character "—" is depressed. The CPU stores the character information — (dash) into the register C and the printer PRT prints "—" as shown in branch 3 of FIG. 8. The CPU updates the content of the line buffer memory LB as shown in FIG. 3(B) by using the working memory WKM and clears the register C. In FIG. 3(B), "(" and ")" are special codes which indicate that a plurality of character information are present in the same printing position and "(" indicates the beginning of the information and ")" indicates the end of the information. After a "—" has been printed, the print head H is again returned to the print position of "1" and the subscript key SBK is depressed. Then the motor M is rotated to move the print paper P upward by one half of line pitch. The CPU stores the distance of movement SC2 into the register S.

When the character key "2" is next depressed, the CPU stores the character information 2 into the register C and writes the contents of the registers C and S into the line buffer memory LB as shown in FIG. 3(C) and in branch 3 of FIG. 8. The printer PRT prints the character "2" and the motor M moves the print paper P downward by one half of line pitch and the print head H is moved to the next print position. The CPU then clears the registers C and S. A method for erasing the fraction comprising the superscript and the subscript printed in the manner described above is now explained. Erasure occurs in response to depression of the correction key CK as shown in Branch 1 of FIG. 8.

The print head H is first positioned to a character group to be erased and the correction key CK is depressed. The CPU looks up the line buffer memory LB to retrieve the information on the printed character group under the print head H as shown in branch 1 of FIG. 8. In the example shown in FIG. 3(C), the CPU first retrieves the special code ")" from the line buffer memory LB, stores the character information 2 in the register C and stores SC2 in the register S, and sets the flag F. Then, the motor M of the printer PRT is rotated to move the print paper P by the distance corresponding to the content stored in the register S so that the print head H is positioned to the print position of "2". Then, the printer PRT erases the printed character "2" and the motor M is rotated in the opposite direction by the distance corresponding to the content of the register S and then the contents of the registers C and S are cleared.

The character information — (dash) is then stored in the register C and the printer PRT erases the character "—" as shown by branch 1 of FIG. 8. Then, the character information 1 and SC1 are stored in the registers C and S, respectively, and the printer PRT erases the printed character "1" in the same manner as described above. Then, the contents of the registers C and S are cleared.

After the characters corresponding to the character information between "(" and ")" in the line buffer memory LB have been deleted, the CPU clears the flag F and clears all information on the fraction characters in the line buffer memory LB again as shown in branch 1 of FIG. 8. In this manner the fraction characters comprising the superscript and the subscript are completely erased and the information thereon stored in the line buffer memory LB are also completely cleared.

Figure 4:
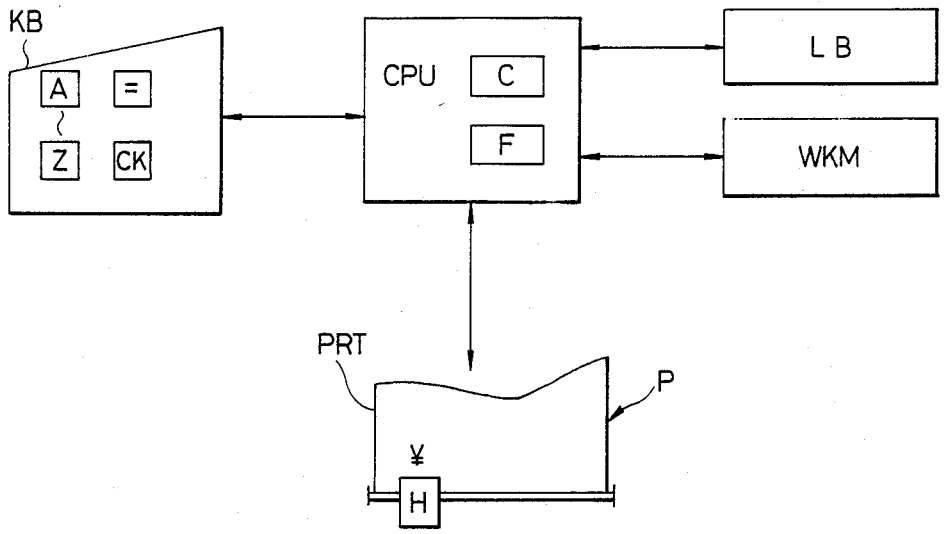
FIG. 4 shows a block diagram of a second embodiment of the present invention.

FIG. 4 shows a block diagram of a second embodiment of the present invention. KB denotes a keyboard which has character keys, a correction key CK and other character keys and control keys (some of which are not shown). PRT denotes a printer which has a print head H controlled by a central processing unit CPU. The CPU has a register C for storing character information supplied from the keyboard KB and a flag F. LB denotes a line buffer memory similar to the one shown in the first embodiment and WKM denotes a working memory.

Figure 9:
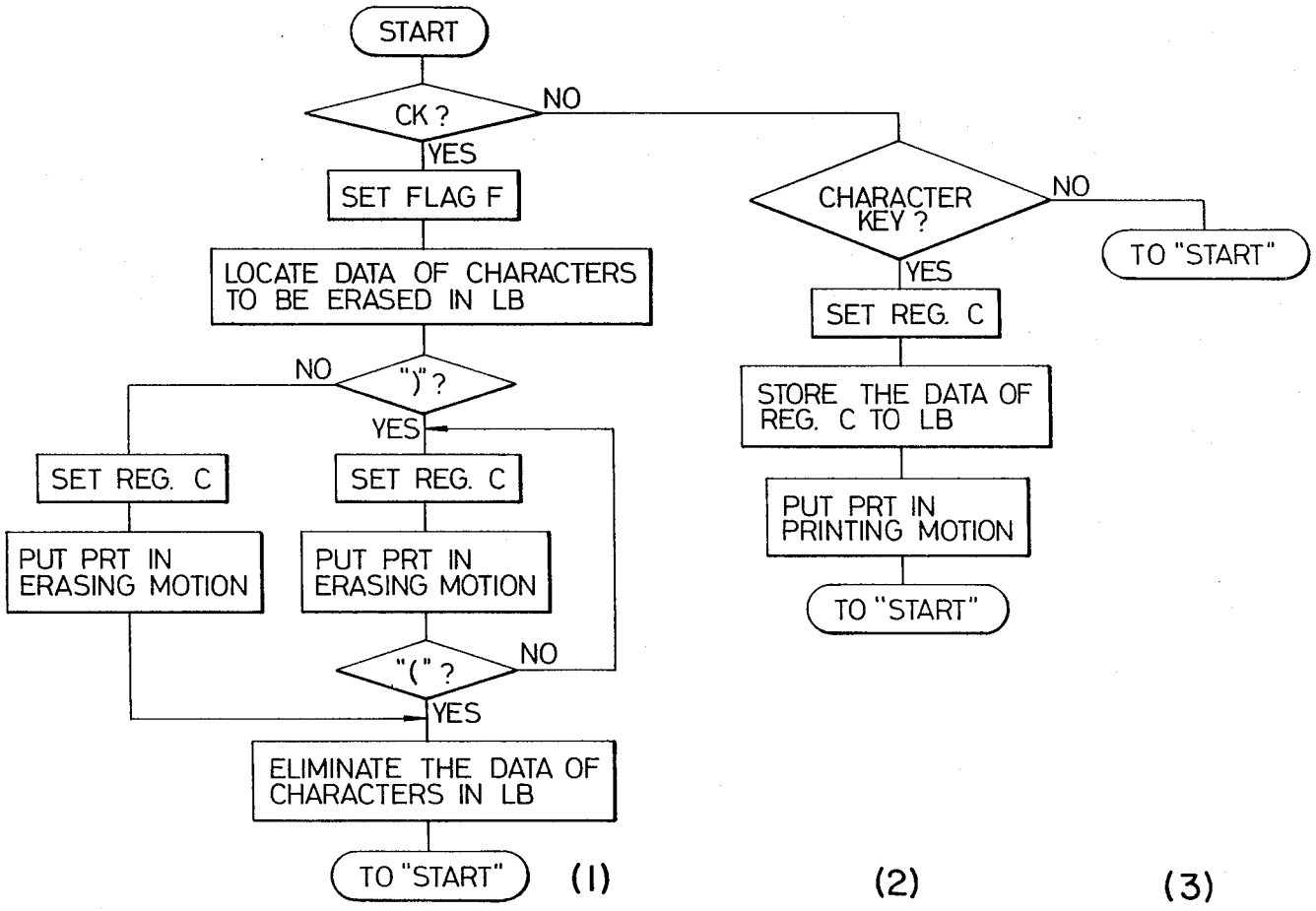

The operation of the present embodiment to print a composite character will now be described. FIG. 9 shows a flow chart of this operation.

Figure 5:
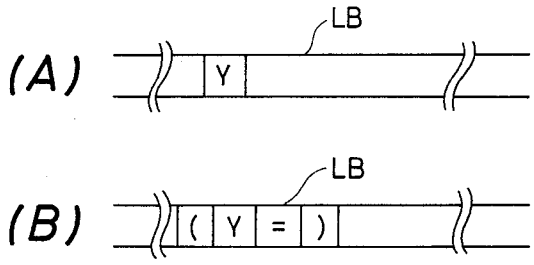
FIG. 5 shows in steps A and B the contents of the line buffer memory.

For example, when the correction key CK has not been depressed but when a composite character "¥" is to be printed, a character key "Y" on the keyboard KB is first depressed as shown in branch 2 of FIG. 9. The CPU stores character information Y in the register C and writes the character information Y in the line buffer memory LB as shown in FIG. 5(A). The printer PRT prints the character "Y" and immediately thereafter the print head H is moved to the next print position.

Then, the print head H is moved back to the print position of "Y" and a character key "=" is depressed. The CPU stores character information = in the register C in the same manner as described above and writes "(Y=)" in the line buffer memory LB as shown in FIG. 5(B) by using the working memory WKM all as shown in branch 2 of FIG. 9.

The symbols "(" and ")" indicate that a plurality of character information are present at the same print position, and "(" indicates the beginning of the character information and ")" indicates the end of the character information. The printer PRT prints "=" so that the composite character "¥" is printed as shown in FIG. 4.

Operation of the present embodiment for erasing the composite character "¥" will now be explained again with reference to FIG. 9.

The print head H is positioned on the character to be erased and the correction key CK is depressed as shown in branch 1 of FIG. 9. The CPU sets the flag F and looks up the line buffer memory LB to retrieve the information on the printed character under the print head H.

In the example of the composite character "¥", the content of the line buffer memory LB shown in FIG. 5(B) is referred and when the special code ")" is retrieved, the character information on the next character "=" is stored in the register C as shown in branch 1 of FIG. 9. Since the flag F has been set, the printer PRT erases the printed character "=" in the manner shown in the U.S. Pat. No. 3,780,846.

Then, the character information Y is stored in the register C. The print head H is not moved and the printed character "Y" is erased. When the special code "(" is retrieved, the flag F is cleared and the character information Y= as well as ( ) in the line buffer memory LB are cleared as shown in branch 1 of FIG. 9.

In this manner, a sequence of erase operations for the composite character are effected automatically by one correction key depression.

Figure 6:
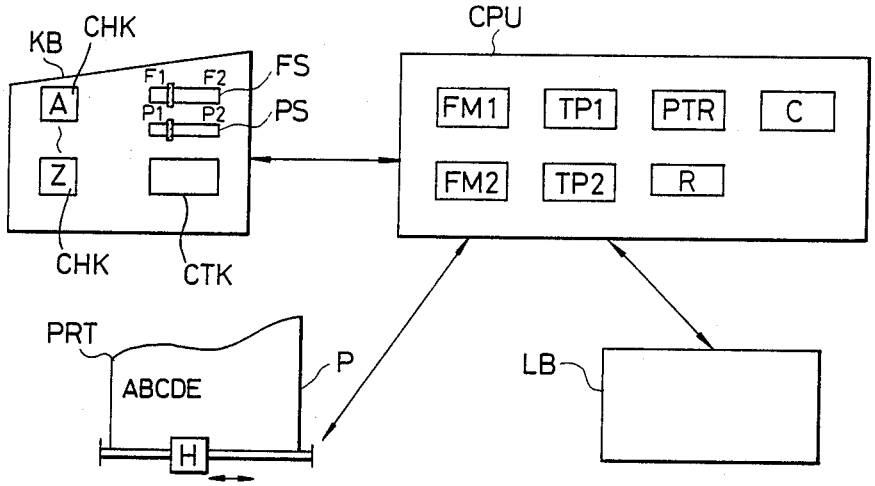
FIG. 6 shows a control block diagram of a third embodiment of the present invention.

FIG. 6 shows a block diagram of a third embodiment of the present invention. KB denotes a keyboard which has numeric keys and character keys CHK as well as control keys CTK and a slide switch PS for changing a print pitch and a slide switch FS for changing a print form. CPU denotes a central processing unit which has a register C for storing character information, a pointer PTR which points to an address of the character information stored in the line buffer memory LB corresponding to a print head H of a printer PRT, a register FM1 for storing the print form information from the slide switch FS, a register FM2 for storing the print form information for the character information stored in the line buffer memory LB pointed to by the pointer PTR, a register TP1 for storing the print pitch information from the slide switch PS, a register TP2 for storing the print pitch information for the character information stored in the line buffer memory LB pointed to by the pointer PTR, and a register R for storing distance information SP from a center of a print head H to a center of the character printed on the left of the print head H and closest to the print head H (or left end of a print paper P if the printed character is not present on the left of the print head H). When the print head H is positioned at the center of the printed character, the register R stores "0".

Figure 7:
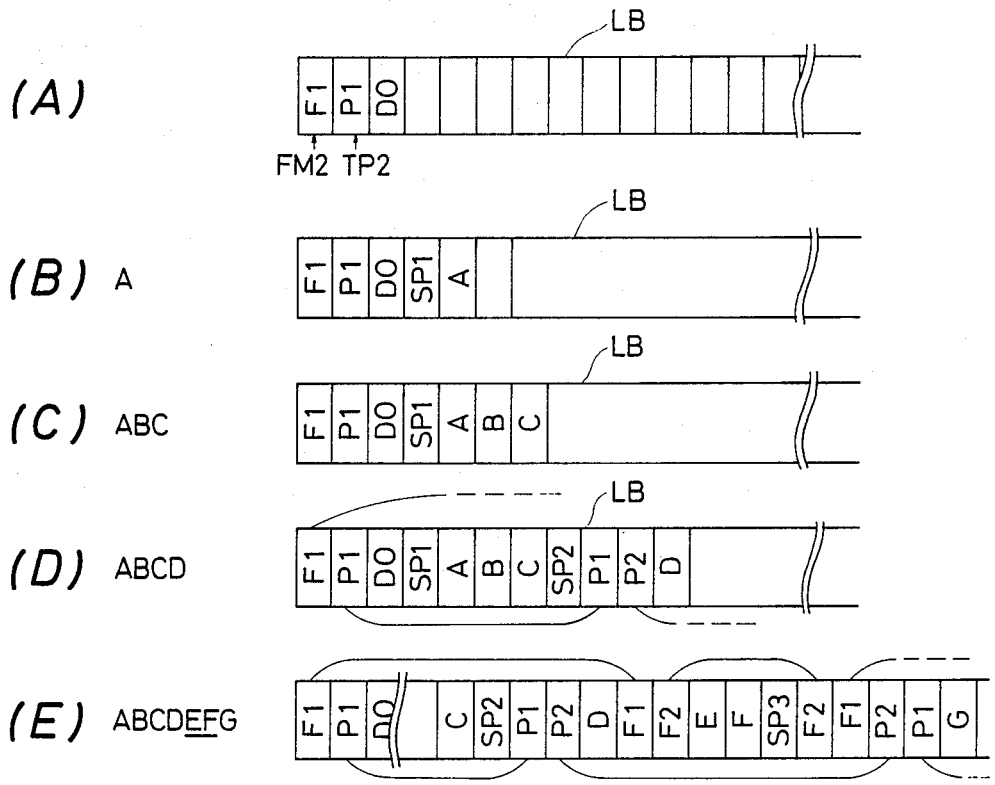
FIG. 7 shows in steps A through E a sequence of print examples and corresponding contents of the line buffer memory.

FIG. 7 shows printing examples in the present embodiment and the corresponding contents of the line buffer memory LB. The operation is now explained with reference to FIG. 7 and to the flow chart of FIGS. 10A and 10B.

Figure 10A:
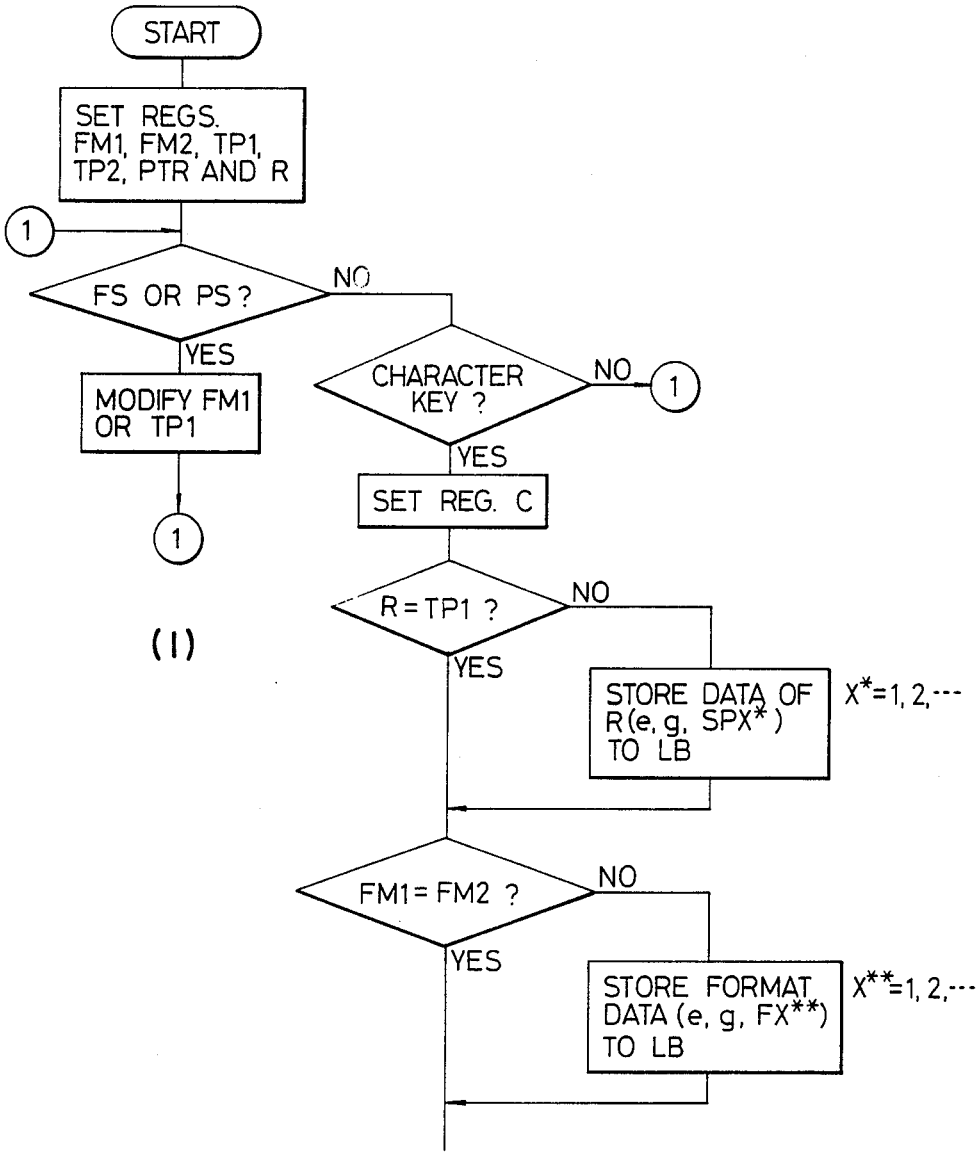

In an initialization step when a power supply is turned on, the CPU stores the print pitch information from the slide switch PS on the keyboard KB and the print form information from the slide switch FS into the registers TP1 and TP2 and the registers FM1 and FM2, respectively, and stores the distance information SP1 from the left end of the print paper P to the print head H into the register R as shown in branch 1 of FIG. 10A. The contents of the registers FM2 and TP2 are written into the line buffer memory LB as F1 and P1, respectively, as shown in FIG. 7(A). The pointer PTR then points to an address of D0. The address D0 indicates the beginning of the line and it also indicates the left end of the print paper P. It is assumed that the slide switch PS is set to P1 and the slide switch FS is set to F1.

Figure 10B:
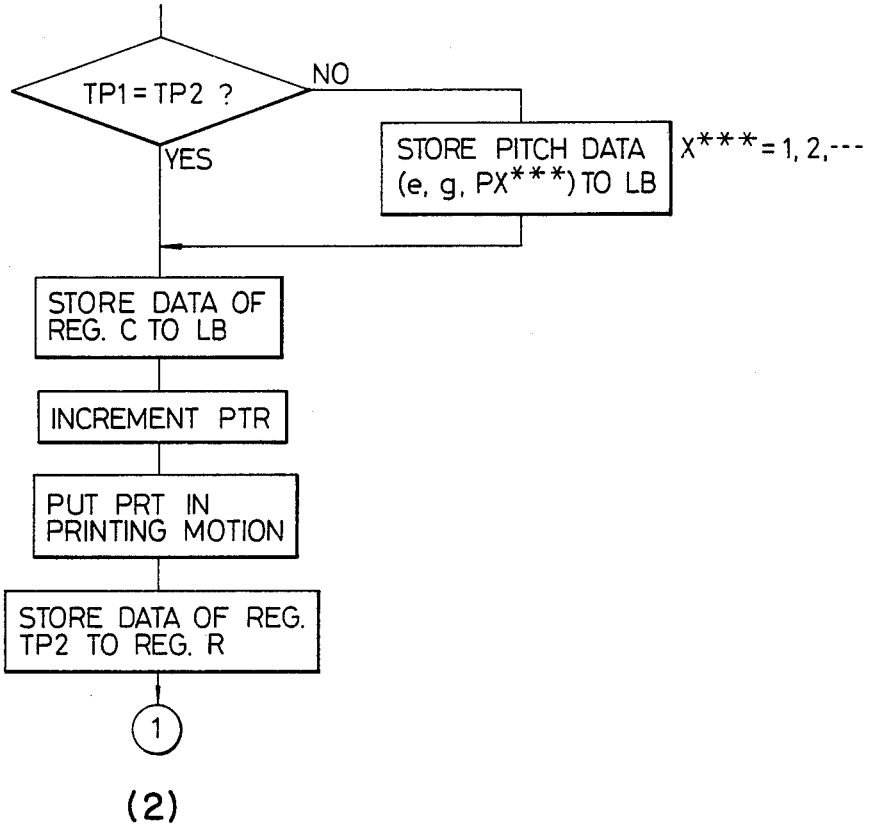

Under this condition, when a key "A", for example, on the keyboard KB is depressed, the CPU stores the character information A in the register C and compares an escapement amount derived from the print pitch information P1 in the register TP1 with the distance information SP1 in the register R, and if they are not equal, stores the distance information SP1 of the register R and the character information of the register C in the line buffer memory LB as shown in FIG. 7(B) as shown in branch 2 of FIGS. 10A and 10B. The pointer PTR then points to an address at which the character information A is stored. The printer PRT prints the character "A" and then the register C is cleared. The print head H is moved rightward by the escapement amount derived from the print pitch information P1 in the register TP1, and the distance of movement is stored in the register R.

When keys "B" and "C" on the keyboard KB are then depressed, the escapement amount derived from the print pitch information P1 in the register TP1 is equal to the distance information in the register R and hence only the character information B and C are stored in the line buffer memory LB as shown in FIG. 7(C). When the slide switch PS for changing the print pitch is slid from position P1 to position P2 and a key "D" is depressed, the pitch information P2 from the slide switch PS is stored in the register TP1 and the character information D is stored in the register C. Since the escapement amount derived from the pitch information P2 of the register TP1 is not equal to the distance information in the register R, the content of the register R is written in the line bufer memory LB as SP2 as shown in FIG. 7(D). The contents P1 and P2 of the registers TP2 and TP1 as well as the character information D of the register C are written in the line buffer memory LB as shown in FIG. 7(D) in order to indicate the change of the print pitch information.

The printer PRT prints the character "D" and the print head H is moved by the escapement amount derived from the content P2 of the register TP1. The distance of movement is stored in the register R.

It is now assumed that the slide switch FS for changing the print form is slid from F1 to F2 to change the print form to characters with underline, and keys "E" and "F" are depressed. The print form information from the slide switch FS is stored in the register FM1, and the contents of the registers FM1 and FM2 are written in the line buffer memory LB as F1 and F2, as shown in FIG. 7(E). The pointer PTR is incremented to point to the address at which the character information F is stored.

The printer PRT prints the characters "E" and "F" in accordance with the print form (with underline) specified by the register FM1, and the print head H is moved to the next print position in accordance with the print pitch information P2. The distance of movement is stored in the register R. When the print form is set to F1 and the print pitch is set to P1 and a key "G" is depressed, the information are stored as shown in FIG. 7(E) in the same manner as described above.

An operation for moving the print head H in the reverse direction to a character position to be corrected when the correction is required and is described below.

When the character "A" shown in FIG. 7(D) is to be corrected from the printing position of the character "D", the print pitch P2, . . . in the line buffer memory LB are sequentially pointed by the pointer PTR and decoded. The print pitches P2 and P1 are sequentially stored in the register TP2. Thus, the register TP2 stores at this step, and holds the information P1. Then, SP2 is decoded and the head H is moved leftward by the distance corresponding to SP2. Thus, the print head H is exactly moved from the position of the character "D" to the position of the character "C". Thereafter, the print head H is moved to the character positions C→B→A in accordance with the print pitch P1 stored in the register TP2. Then, SP1 is read and the print head H is returned to the start position of the line. P1 and F1 at the left end of the line buffer memory LB are used when the print head H is moved rightward for the correction operation if the print head H has inadvertently been moved leftward too much.

By providing the print pitch information, for example, P1 on the opposite sides of the character information like P1, D0, SP1, A, B, C, SP2, P1 in the line buffer memory LB as shown in FIG. 7(D), the correction operation can be effected during the movement of the print head H in either direction. Another example is shown in FIG. 7(E) by P2, D, F1, F2, E, F, SP3, F2, F1, P2. In FIG. 7(D), since the print format does not change, only the leftmost F1 is stored. In FIG. 7(E), F1—F1 and F2—F2 are stored as shown.

As described hereinabove, according to the present invention, the character information on the composite character consisting of two or more characters is stored, and when the correction key is depressed, the composite character is deleted based on the stored composite character information. Thus, the composite character is automatically deleted in a very short time by one correction key depression and hence the efficiency of operation is significantly improved.

Furthermore, since the print form information and the print pitch information are stored but not for each character, the required capacity of the line buffer memory, that is the amount of line buffer storage needed, is reduced and the line buffer memory can be effectively utilized. In automatic correction, a large volume of correction information can be stored in the line buffer memory so that a wide range of automatic correction can be made for the printed character.

What we claim is:

1. A printing apparatus comprising:

printing means for printing characters on a printing paper;

memory means for storing a plurality of character information, each representing a character, in the same order as characters represented thereby are printed by said printing means, said memory means being capable of storing a sub-plurality of character information and a pair of special codes one of which is stored at the beginning of the sub-plurality of character information and the other of which is stored at the end of the sub-plurality of character information, said special codes indicating that the sub-plurality of character information stored therebetween is composite character information;

correcting means for erasing characters printed by said printing means;

a correction key for signaling that erasure by said correcting means is to be initiated; and control means for reading the pair of special codes and the composite character information stored therebetween from said memory means in response to actuation of said correction key and for controlling said correcting means to erase the composite characters printed on a printing paper and represented by the composite character information stored between the special codes.

2. A printing apparatus according to claim 1, wherein the composite character information includes information representing a fraction having a superscript and a subscript.

3. A printing apparatus according to claim 1, wherein said control means includes a motor capable of advancing and reversing movement of the printing paper in said apparatus.

4. A printing apparatus according to claim 1, wherein said memory means is also capable of storing information representing at least one of a print form and a print pitch.

5. A printing apparatus comprising:

a first character key for inputting a first character;

a second character key for inputting a second character;

printing means for printing the first and second characters on a printing paper in response to actuation of said first character key and said second character key;

a correction key;

erasing means for erasing the printed character on the printing paper in response to actuation of said correction key;

instruction means for instructing a movement of said printing means;

first memory means, after printing the first character input by said first character key, for making said printing means opposed to a print position of the first character in response to the instruction of said instruction means, and then storing a composite character without adding any qualifier information between first and second character information, the composite character being obtained by printing the second character input through said second character key and including the first and second characters;

said memory means responsive to operation of said correction key for sequentially storing, character by character, the first and second character information from said first memory means; and control means for sequentially transmitting the first and second character information from said first memory means to said second memory means to conduct individual erasing operations on said first and second characters by said erasing means.

6. A printing apparatus according to claim 5, further comprising means for producing a pair of special codes, said pair of special codes being disposed such that said first and second character information are located therebetween, said first and second character information forming the composite information and being stored in said first memory means, and wherein said control means includes means for detecting the pair of special codes.

7. A printing apparatus comprising:

a first character key representing a first character;

a second character key representing a second character;

an erasure instruction key for instructing an erasure operation;

erasure means for erasing the character printed on a recording sheet;

recording sheet feed means capable of reciprocally feeding the recording sheet;

first memory means for storing recording sheet feed information, first character information and second character information when the first character and the second character are printed at the horizontally same position, the recording sheet feed information representing a quantity of the recording sheet to be fed between the printing of the first character and the printing of the second character, the first character information representing the first character, and the second character information representing the second character;

second memory means for sequentially fetching and storing the first and second character information stored in said first memory means; and control means for controlling said erasure means and said recording sheet feed means such that, in the case of performing the erasure operation responsive to the instruction of said erasure instruction key, the first and second character information are fetched from said first memory means to said second memory means, and after erasing the first character the feeding of the recording sheet in a direction opposite to the direction in a printing operation is performed in response to the recording sheet feed information, after which the second character is erased.

8. A printing apparatus according to claim 7, wherein at least one of the first and second characters includes a superscript or a subscript.

9. A printing apparatus according to claim 7, wherein said second memory means stores one of the character information.

10. A character processing apparatus comprising:

first memory means capable of storing a plurality of character information respectively representing printed characters;

first input means for inputting the character information representing the character to be printed;

second input means for inputting print information required for the print operation;

second memory means for storing the print information input by said second input means;

print means for printing the character information input by said first input means, in response to the print information input by said second input means;

comparison means for comparing the print information previously input by said second input means with newly input print information; and memory control means for storing the newly input print information into said second memory means when in said comparison means it is discriminated that the newly input print information is different from the previously input print information.

11. A character processing apparatus according to claim 10, wherein said memory control means interrupts the storage of the newly input print information into said second memory means when in said comparison means it is discriminated that the previously input print information and the newly input print information are the same.

12. A character processing apparatus according to claim 11, wherein the print information includes form information representing print character pitch, underline, thickness of indicia and double width.

13. A character processing apparatus according to claim 12, wherein said first memory means and said second memory means comprise one same memory means.

* * * * *